US005957783A

United States Patent [19]

Cheng

[11] Patent Number: 5,957,783

[45] Date of Patent: Sep. 28, 1999

[54] GOLF CLUB SHAFT HAVING CONTOURED GRIP SECTION AND KICK SECTION

[75] Inventor: Michael H. L. Cheng, Simi Valley, Calif.

[73] Assignee: Harrison Sports Inc., Pacoima, Calif.

[21] Appl. No.: 08/953,124

[22] Filed: Oct. 17, 1997

[51] Int. Cl.[6] ..... A63B 53/14

[52] U.S. Cl. ..... 473/300; 473/303

[58] Field of Search ..... 473/300, 303, 473/318, 319, 320, 321, 322, 323, 226, 228

[56] References Cited

U.S. PATENT DOCUMENTS

| | | |
|---|---|---|
| Re. 33,735 | 11/1991 | Rumble et al. . |
| 1,418,038 | 5/1922 | Tousey . |
| 2,086,275 | 7/1937 | Lemmon . |
| 2,117,129 | 5/1938 | Young . |
| 2,250,441 | 7/1941 | Vickery . |
| 3,614,101 | 10/1971 | Hunter . |
| 3,809,403 | 5/1974 | Hunter . |
| 4,205,845 | 6/1980 | Kanne . |
| 4,431,187 | 2/1984 | Rumble et al. . |
| 5,251,896 | 10/1993 | Gerlach . |
| 5,316,299 | 5/1994 | Feche et al. . |
| 5,496,028 | 3/1996 | Chien . |
| 5,665,010 | 9/1997 | Mori . |
| 5,695,408 | 12/1997 | DeLaCruz et al. . |
| 5,735,752 | 4/1998 | Antonious . |
| 5,735,753 | 4/1998 | Hoffmeyer . |
| 5,755,826 | 5/1998 | Beach et al. ..... 473/316 |
| 5,820,480 | 10/1998 | Cheng . |

FOREIGN PATENT DOCUMENTS

| | | | |
|---|---|---|---|
| 389353 | 3/1933 | United Kingdom | 273/80 B |

*Primary Examiner*—Kien T. Nguyen
*Attorney, Agent, or Firm*—Henricks, Slavin & Holmes LLP

[57] ABSTRACT

A golf club shaft having a main body section and a grip section associated with the proximal end of the main body section. The grip section includes a top hand portion, a bottom hand portion and a substantially cylindrical bottom thumb portion. Alternatively, or in addition, a kick section may be provided between the grip section and main body section.

28 Claims, 6 Drawing Sheets

GOLF CLUB SHAFT HAVING CONTOURED GRIP SECTION AND KICK SECTION

BACKGROUND OF THE INVENTION

1. Field of Invention

The present invention relates generally to golf clubs and, more particularly, to golf club shafts.

2. Description of the Related Art

Over the years, many substitutes have been introduced for the hard wood shafts originally used in golf club drivers and irons. Early substitute materials included stainless steel and aluminum. More recently, carbon fiber reinforced resin shafts have become popular. Fiber reinforced resin shafts are typically hollow and consist of a shaft wall formed around a tapered mandrel. The mandrel typically consists of three mandrel sections. The first mandrel section forms the tip section of the shaft, the second mandrel section forms the main body section, and the third mandrel section forms the grip section. Shafts formed in this manner typically have a constant taper from the tip/main body intersection to the main body/grip intersection. Additionally, a grip is often placed over the grip section to facilitate the golfer's grasp of the club.

As shown in FIG. 1A, the grip section of a conventional shaft is often substantially cylindrical over its entire length. Here, the grip (shown in dotted lines) is tapered in an attempt to make the grip portion of the golf club, i.e. the portion which consists of the grip and the grip section of the shaft, conform to the shape of the golfer's hands. Referring to FIG. 1B, other conventional golf club shafts, often referred to as "large butt" shafts, include a grip section which tapers from one end to the other. Here, the thickness of the grip (shown in dotted lines) is substantially uniform over its entire length. As such, from the standpoint of the golfer's hands, the respective grip portions of the clubs shown in FIGS. 1A and 1B are essentially the same, i.e. there is a straight taper from one end of the grip portion to the other. The slope of the straight taper is typically such that the outer diameter of the grip portion decreases at a rate of 0.0285 inch/inch of shaft length.

The inventor herein has determined that there are a number of disadvantages associated with the conventional golf club shafts shown in FIGS. 1A and 1B. For example, the straight taper does not conform well to the contour of the golfer's hands. This is especially true with respect to the bottom hand, which is the right hand for right-handed golfers and the left hand for left-handed golfers. Additionally, there are many instances where a golfer will want to "choke up" on a club, i.e. move his or her hands to a lower position on the shaft, to decrease the distance the ball will travel. With a conventional club, this will change the golfer's top hand grip on the club, as well as the more important bottom hand and bottom thumb grip on the club, because the outer diameter (OD) of the grip portion of the club decreases from one end to the other.

Turning to FIG. 1C, another type of conventional shaft includes a main body section with a relatively large OD, a conventionally sized grip section and a short connecting section therebetween. Such shafts are often referred to as "wide body" shafts. Such a shaft is disclosed in U.S. Pat. No. 5,316,299 to Feche et al. The primary benefit of a wide body shaft is that, for a given shaft wall thickness, the wide body shaft will be stiffer than other conventional shafts. The stiffest portion of certain wide body shafts is the portion of the main body section which abuts the connecting section because this is where the OD of the main body section is the greatest. The inventor herein has determined that this can be undesirable for some golfers.

SUMMARY OF THE INVENTION

Accordingly, the general object of the present invention is to provide a golf club shaft which avoids, for practical purposes, the aforementioned problems. In particular, one object of the present invention is to provide a golf club shaft which conforms more closely to a golfer's hands than a conventional shaft. Another object of the present invention is to provide a "wide body" shaft with greater flexibility near the grip section than conventional "wide body" shafts.

In order to accomplish some of these and other objectives, a golf club shaft in accordance with one embodiment of the present invention has a main body section and a grip section associated with the proximal end of the main body section. The grip section includes a top hand portion, a bottom hand portion, and a substantially cylindrical bottom thumb portion. One of the top and bottom hand portions may be tapered, while the other is substantially cylindrical. Such a shaft provides a number of advantages over conventional shafts. For example, a golf club incorporating the present shaft will have a grip portion with a contour that is closer to the natural contour of the golfer's hands than clubs employing conventional shafts and/or conventional shaft/grip arrangements. Because the OD of the generally cylindrical bottom thumb portion is substantially constant, a golfer can choke up on the club without altering the golfer's important bottom thumb grip on the shaft. Moreover, the grip section can be configured such that the bottom hand portion is also substantially cylindrical, thereby further reducing any alteration of the golfer's grip as he or she chokes up on the shaft.

In order to accomplish some of these and other objectives, a golf club shaft in accordance with another embodiment of the present invention includes a grip section, a main body section, and a kick section between the grip section to the main body section. The kick section is more flexible than the adjacent portions of the grip and main body sections. As a result, the flexibility of the shaft is increased in the area adjacent to the grip section, as compared to conventional shafts. The stiffest portion of certain embodiments of the present shaft, which is typically the point of maximum OD in the main body section, is also farther from the grip section than conventional shafts. Such features are of particular benefit in "wide body" shafts which can be too stiff near the grip section for some golfers.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

Figure 1A:
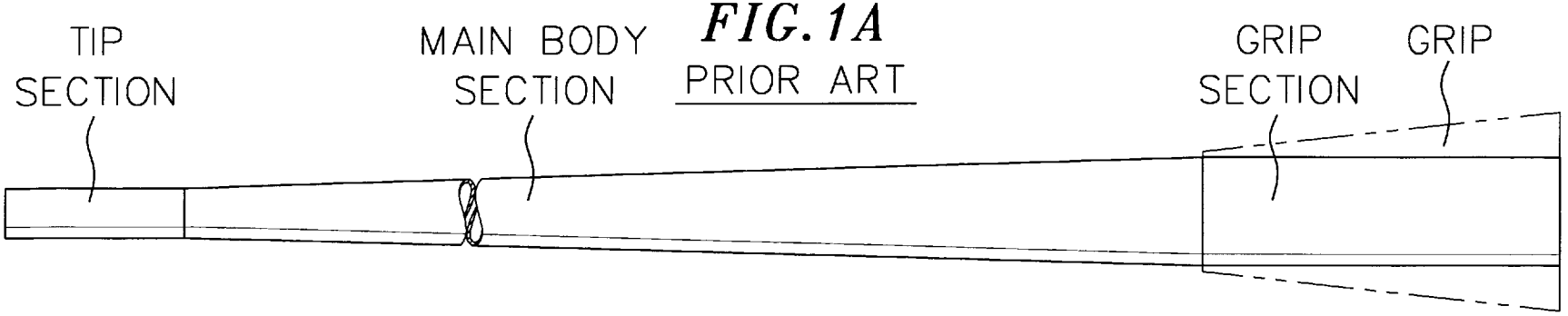
FIG. 1A PRIOR ART
FIG. 1A is a side view of a conventional shaft and grip arrangement.

The following is a detailed description of the best presently known mode of carrying out the invention. This description is not to be taken in a limiting sense, but is made merely for the purpose of illustrating the general principles of the invention. The scope of the invention is defined by the appended claims. Additionally, the exemplary golf club shafts discussed herein are described in terms of the golfer's top and bottom hands. For a right-handed golfer, the right hand is typically the bottom hand, while the left hand is typically the bottom hand for a left-handed golfer.

As illustrated for example in FIG. 2, a golf club shaft 10 in accordance with a preferred embodiment of the present invention includes a grip section 12, a tip section 14, a main body section 16, and a kick section 18 (discussed below) between the main body section and the grip section. The proximal end of the grip section 12 defines the butt end 20 of the shaft, while the distal end of the tip section 14 defines the tip end 22. The grip section 12 includes a frusto-conically shaped tapered top hand portion 24 and a generally cylindrical bottom hand/bottom thumb portion 26. As used herein, a tapered shaft portion is a portion having an outer surface which is sloped relative to the longitudinal axis of the shaft. The OD of the tapered top hand portion 24 is greater than the OD bottom hand/bottom thumb portion 26, except at the intersection between the two, where the two portions have a common OD. Preferably, a grip with a substantially uniform thickness is placed over the grip section 12. As a result, the grip portion of a golf club incorporating the exemplary shaft shown in FIG. 2, i.e. the combined grip and grip section of the shaft, will have a contour that is closer to the natural contour of the golfer's hands than clubs employing conventional shafts and/or conventional shaft/grip arrangements. Moreover, because the OD of the generally cylindrical bottom hand/bottom thumb portion 26 is substantially constant, a golfer can choke up on the club without altering the golfer's bottom hand and bottom thumb grip on the shaft.

The kick section 18 of the exemplary shaft 10 is the intersection point 32 between a frusto-conically shaped proximal connecting portion 28 and a frusto-conically shaped distal connecting portion 30. In other words, in the exemplary embodiment shown in FIG. 2, the kick section is a point with an OD that is less than the OD of the distal portion of the grip section 12 and also less than the largest OD of the main body section 16. As a result, the kick section 18 increases the flexibility of the shaft in the area of the grip section 12. Also, the kick section 18, in combination with the connecting portions 28 and 30, moves the stiffest portion of the main body section (the point of maximum OD) away from the grip section. In order to further increase the flexibility of the shaft, and as discussed below with reference to FIG. 7, the length of the kick section 18 may be increased.

Figure 1B:
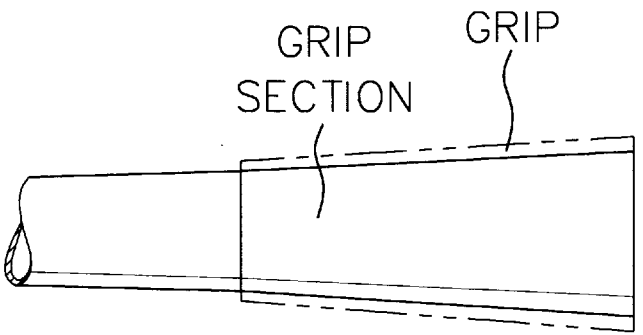
FIG. 1B PRIOR ART
FIG. 1B is a side view of another conventional shaft and grip arrangement.
Figure 1C:
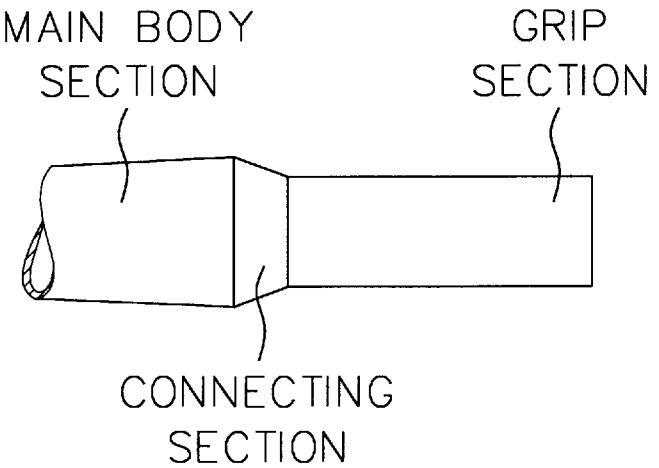
FIG. 1C PRIOR ART
FIG. 1C is a side view of a conventional "wide body" shaft.
Figure 2:
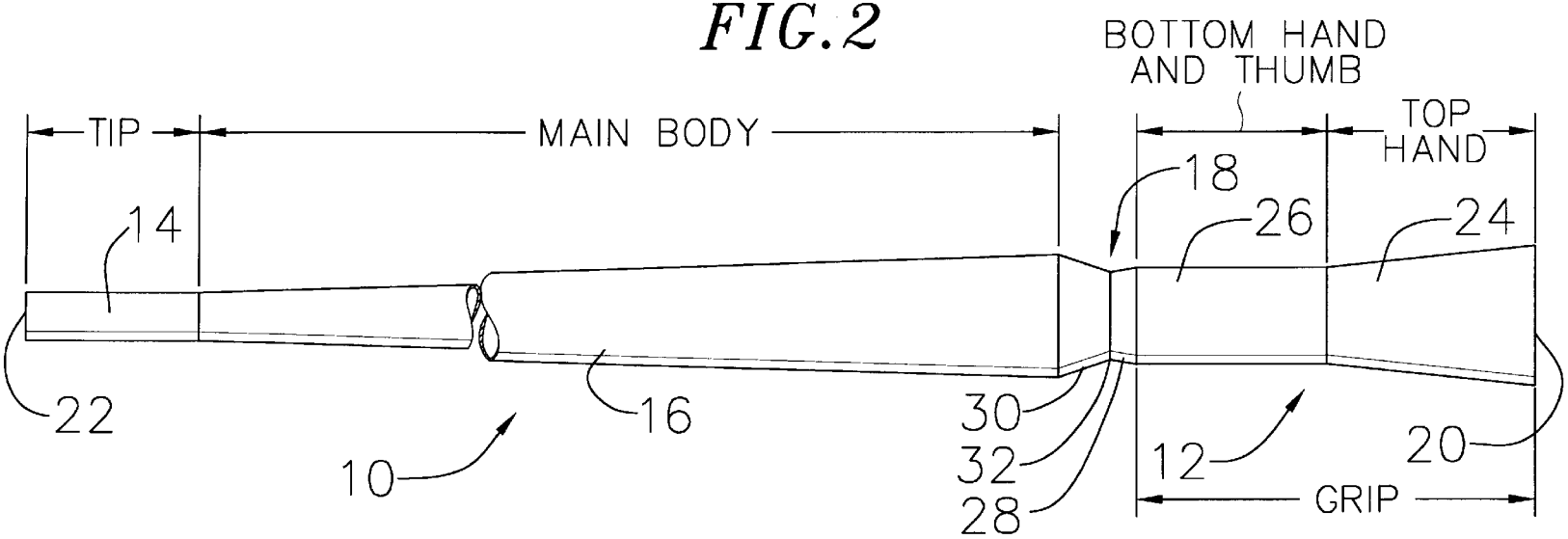
FIG. 2 is a side view of a golf club shaft in accordance with a preferred embodiment of the present invention.
Figure 3:
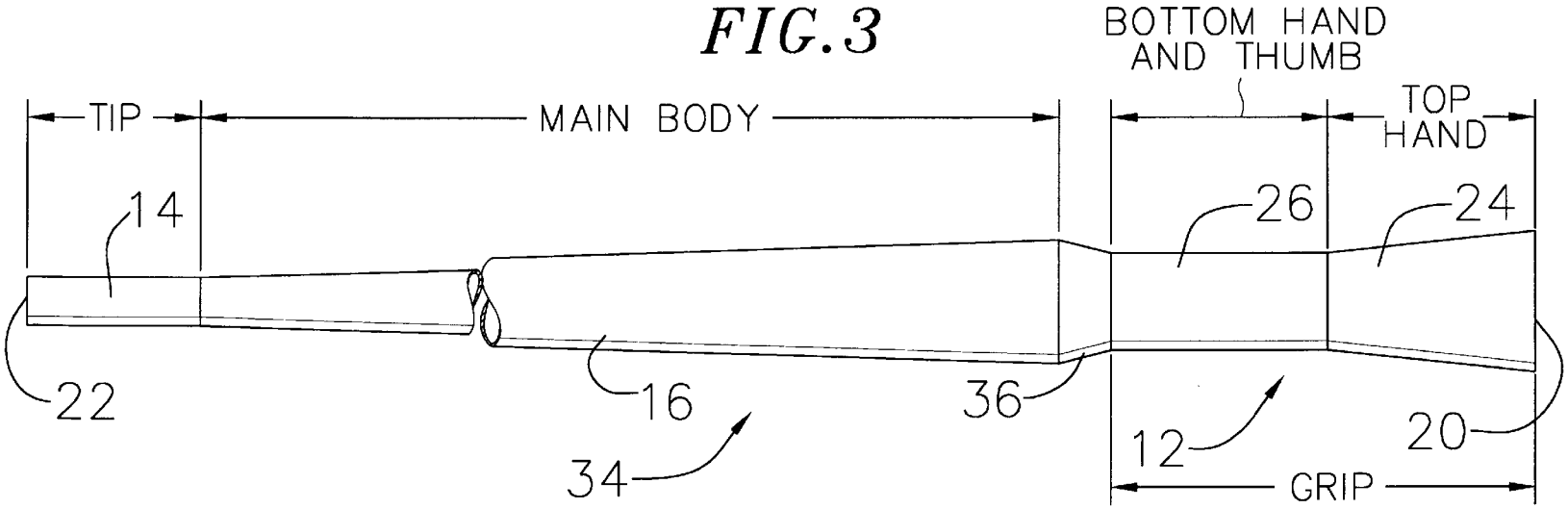
FIG. 3 is a side view of a golf club shaft in accordance with another preferred embodiment of the present invention.
Figure 4:
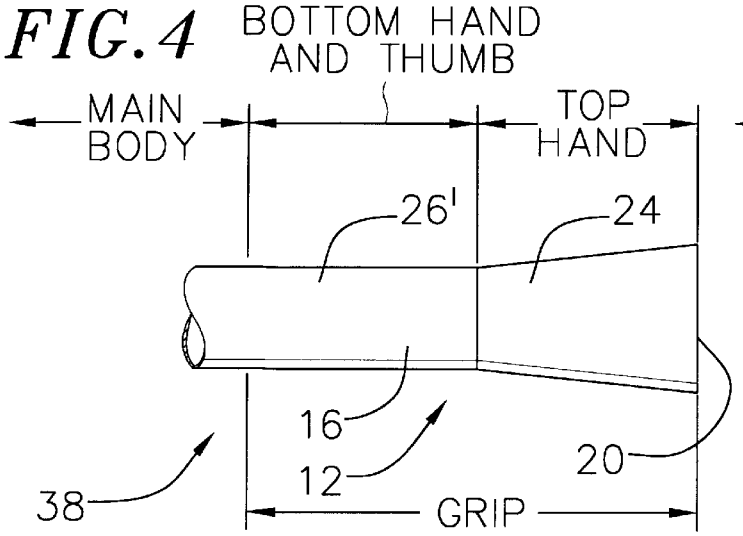
FIG. 4 is a partial side view of a golf club shaft in accordance with still another preferred embodiment of the present invention.

The grip section 12 may be incorporated into a variety of shafts in addition to the exemplary shaft shown in FIG. 2. For example, the exemplary golf club shaft 34 shown in FIG. 3 is substantially similar to the shaft shown in FIG. 2. In the shaft shown in FIG. 3, however, there is no kick section. A frusto-conically shaped outwardly tapered section 36 connects the bottom hand/bottom thumb portion 26 of the grip section to the main body section 16. Other aspects of the shafts being equal, the exemplary shaft shown in FIG. 2 will be more flexible than the exemplary shaft shown in FIG. 3. Another exemplary shaft incorporating grip section 12 is illustrated in FIG. 4. The exemplary shaft 38 shown in FIG. 4 will be more flexible than that shown in FIG. 3 because the OD of the proximal end of the main body section is reduced. The grip section 12 of shaft 38 includes a bottom hand/bottom thumb portion 26' which has a slight taper (the OD decreases at a rate of about 0.006 to about 0.009 inch/inch of shaft length). The taper corresponds to that of the main body section 16. Thus, the taper of the shaft 38 is substantially constant from the tip section to the distal end of top hand portion 24 of the grip section. The slope of this taper is, of course, far less than the slope of the respective tapers of the conventional grip portions shown in FIGS. 1A and 1B. Thus, although there is slight change in grip as a golfer chokes up on the shaft shown in FIG. 4, such a shaft nevertheless an improvement over conventional shafts, especially with respect to the contour of the grip section.

Figure 5:
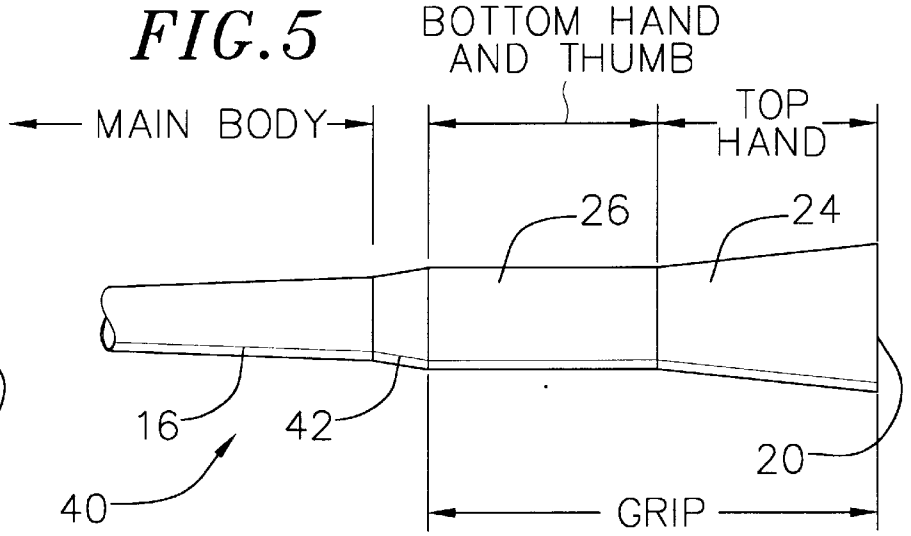
FIG. 5 is a partial side view of a golf club shaft in accordance with yet another preferred embodiment of the present invention.

Turning to FIG. 5, shaft stiffness may be further reduced by reducing the OD of the main body section 16 to such an extent that the OD of the proximal end thereof is less than that of the distal end of the bottom hand/bottom thumb section 26, as is the case in exemplary shaft 40. Here, an inwardly tapered section 42 connects the bottom hand/bottom thumb portion 26 of the grip section to the main body section 16.

Figure 6:
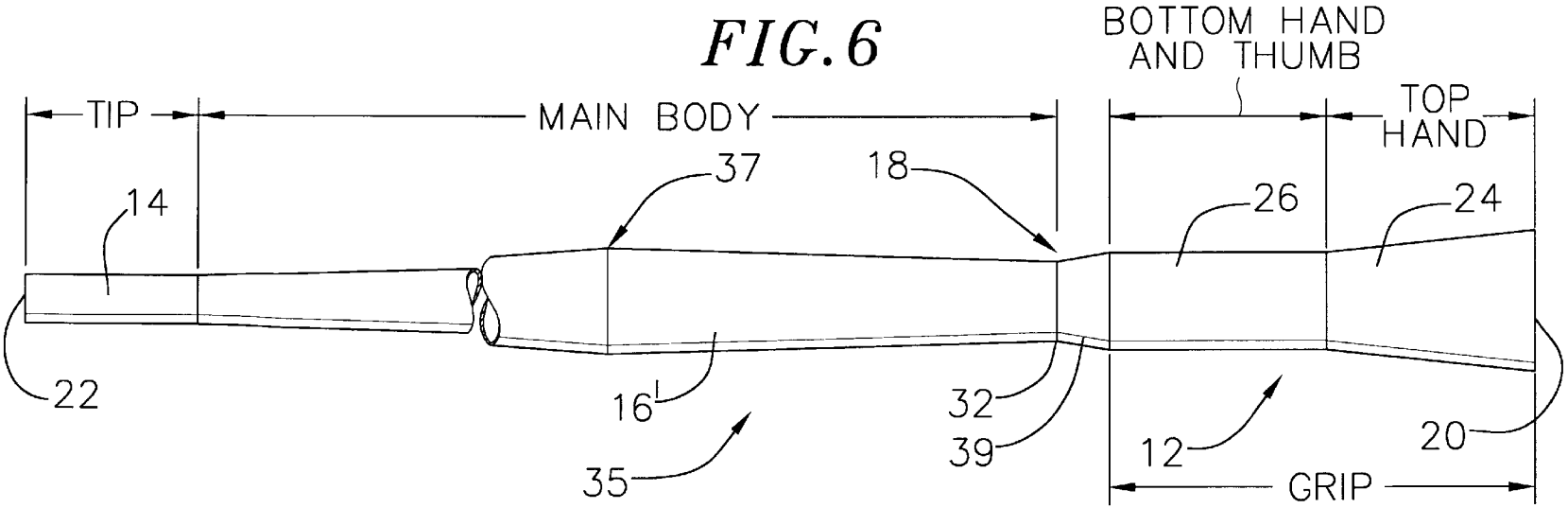
FIG. 6 is a side view of a golf club shaft in accordance with still another preferred embodiment of the present invention.

The grip section 12 shown in FIG. 2 may be incorporated into a shaft having a main body section which is configured such that the point of largest main body section OD is substantially spaced from the grip section. Referring more specifically to the exemplary shaft 35 shown in FIG. 6, the main body section 16' is configured such that the point of maximum OD 37 is at least about 1 inch from the kick section 18. The shaft is also provided with a frusto-conically shaped proximal connecting portion 39. Such a configuration further increases the flexibility of the shaft near the grip section 12.

Figure 7:
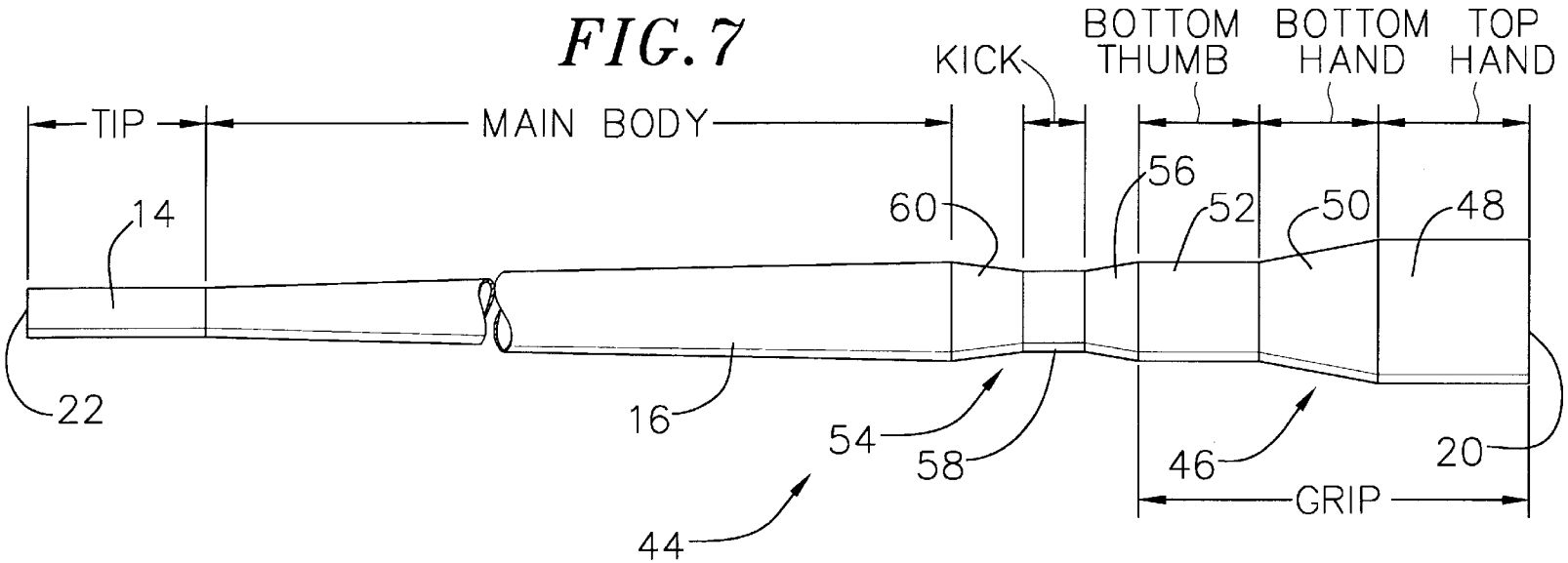
FIG. 7 is a side view of a golf club shaft in accordance with another preferred embodiment of the present invention.

In order to more closely conform to the contour of the golfer's hands, the exemplary shaft 44 shown in FIG. 7 includes a slightly different grip section than the grip section discussed above with reference to FIGS. 2–6. More specifically, exemplary shaft 44 includes a grip section 46 which consists of a substantially cylindrical top hand portion 48, a frusto-conically shaped tapered bottom hand portion 50, and a substantially cylindrical bottom thumb portion 52. The use of a grip having uniform thickness is also preferred here. The exemplary shaft 44 shown in FIG. 7 also includes a kick section 54. Here, the kick section consists of an elongate substantially cylindrical portion 58. The kick section is connected to the grip section 46 and main body section 16 by a frusto-conically shaped connecting portion 56 and a frusto-conically shaped connecting tapered portion 60. Like the exemplary kick section 18 illustrated in FIG. 2, exemplary kick section 54 creates an area of reduced OD near the grip section. The kick section 54 defines an OD that is less than the OD of the distal portion of the grip section 46 and that is also less than the largest OD of the main body section 16. This area is more flexible than the grip section and the proximal portion of the main body section. The kick section 54 shown in FIG. 7 is also longer (and, therefore, more flexible given the same OD) than the kick section 18 shown in FIG. 2.

Figure 8:
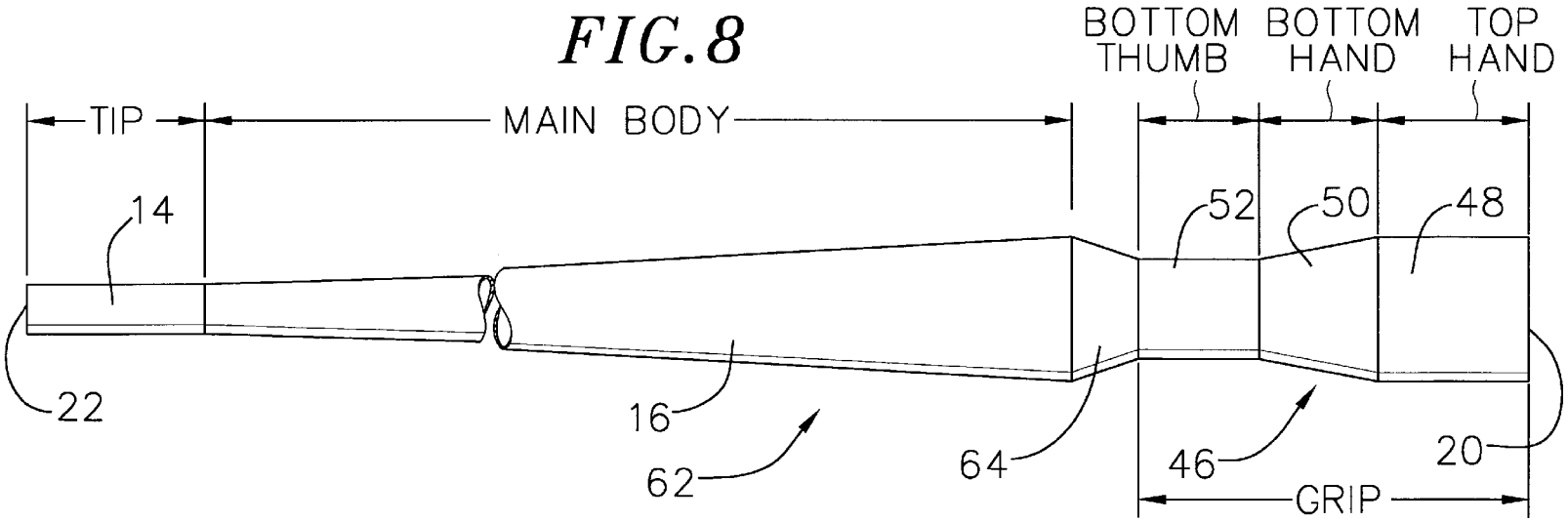
FIG. 8 is a side view of a golf club shaft in accordance with still another preferred embodiment of the present invention.
Figure 9:
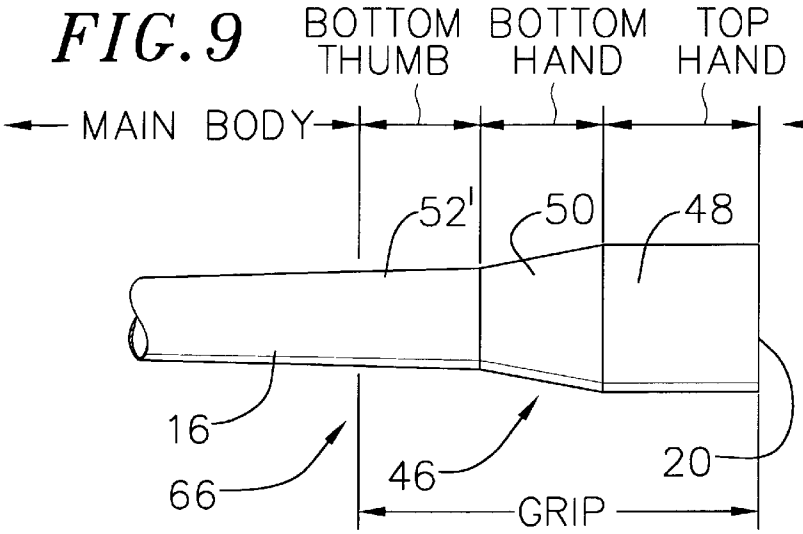
FIG. 9 is a partial side view of a golf club shaft in accordance with yet another preferred embodiment of the present invention.

The grip section 46 shown in FIG. 7 may also be incorporated into a variety of golf club shafts that do not include a kick section. As illustrated for example in FIG. 8, exemplary shaft 62 includes a frusto-conically shaped outwardly tapered section 64 which connects the bottom thumb portion 52 of the grip section to the main body section 16. As discussed above with reference to FIG. 3, such a shaft will be relatively stiff. Another exemplary shaft incorporating the grip section 46 is illustrated in FIG. 9 and is generally indicated by reference numeral 66. Other factors being equal, the exemplary shaft 66 shown in FIG. 9 will be more flexible than the shaft shown in FIG. 8 because the OD of the main body section has been reduced. The grip section 46 of shaft 66 includes a bottom thumb portion 52' which has a slight taper. The taper corresponds to the taper of the main body section 16, thereby making the taper of exemplary shaft 66 substantially constant from the distal end of the bottom hand portion 50 to the tip section. The slope of the taper is, of course, far less than the slope of the taper of the conventional grip portions shown in FIGS. 1A and 1B.

Figure 10:
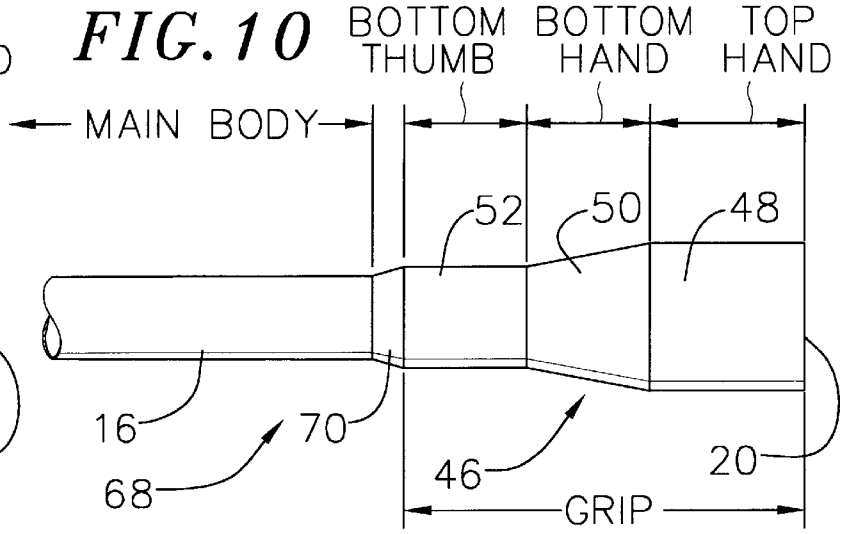
FIG. 10 is a partial side view of a golf club shaft in accordance with another preferred embodiment of the present invention.

Referring to FIG. 10, and as discussed above with reference to FIG. 5, shaft stiffness may be further reduced by decreasing the OD of the main body section 16 to such an extent that the OD of the proximal end thereof is less than that of the distal end of the bottom thumb portion 52, as is the case in exemplary shaft 68.

The bottom thumb portion 52 of the grip section is connected to the main body section 16 by a frusto-conically shaped inwardly tapered section 70.

Figure 11:
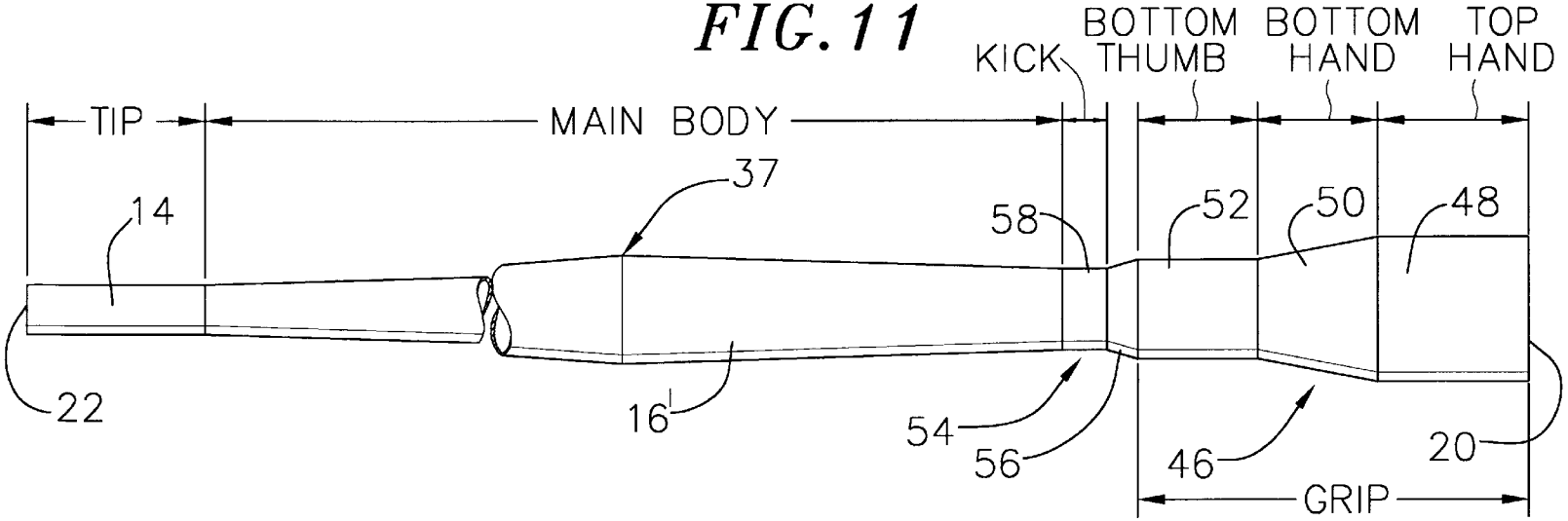
FIG. 11 is a side view of a golf club shaft in accordance with still another preferred embodiment of the present invention.

As illustrated for example in FIG. 11, the grip section 46 shown in FIG. 7 may be incorporated into a shaft having a main body section which is configured such that the point of largest main body section OD is substantially spaced from the grip section. More specifically, and as discussed above with reference to FIG. 6, the main body section 16' is configured such that the point of maximum OD 37 is at least about 1 inch from the kick section 54. Such a configuration further increases the flexibility of the shaft near the grip section 46.

Figure 13:
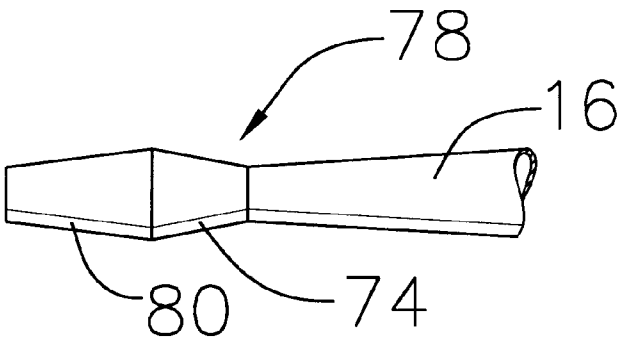
FIG. 13 is a side view of another golf club shaft tip section that may be used in conjunction with the golf club shafts shown in FIGS. 2–11.

The exemplary shafts discussed above with respect to FIGS. 2–11 may include the generally cylindrical tip section 14 shown in FIGS. 2, 3, 6, 7, 8 and 11. Alternatively, and as illustrated for example in FIG. 12, an exemplary tip section 72 may be provided which includes a frusto-conically shaped outwardly tapered portion 74 and a substantially cylindrical portion 76. Turning to FIG. 13, an exemplary tip section 78 includes the frusto-conically shaped outwardly tapered portion 74 and a frusto-conically shaped inwardly tapered portion 80. Another alternative is to simply make the tip section a continuation of the main body section with the same taper as the main body section.

Figure 12:
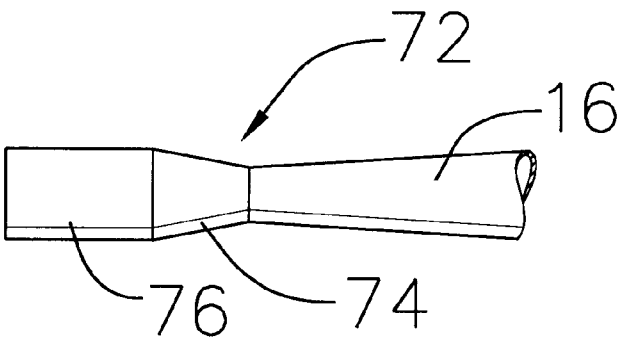
FIG. 12 is a side view of a golf club shaft tip section that may be used in conjunction with the golf club shafts shown in FIGS. 2–11.

Commercial embodiments of shafts in accordance with the present invention may be configured as follows. The overall length of the shafts may range from about 35 inches to about 46 inches. The length of the main body section preferably ranges from about 22 inches to about 33 inches. The OD of the distal end of the main body section is preferably between about 0.37 inch and about 0.50 inch for irons and between about 0.335 and about 0.50 inch for woods. The OD of the proximal end of the main body section may range from about 0.55 inch (FIGS. 5, 6, 10 and 11) to about 0.65 inch (FIGS. 2, 3, 7 and 8). With respect to the tip section, the overall length is preferably between about 4 inches and about 6 inches. The OD of the tip section shown in FIGS. 2, 3, 6, 7, 8 and 11 is preferably between about 0.37 inch and about 0.50 inch for irons and between about 0.335 and about 0.50 inch for woods. The OD of the butt end 20 of shaft preferably ranges from about 0.81 inch to about 1.0 inch.

Where the tip section includes two portions, as shown by way of example in FIGS. 12 and 13, the length of portion 74 preferably ranges from about 1 inch to about 2 inches, while the length of portions 76 and 80 is preferably between about 3 inches and about 4 inches. The OD of tapered portion 74 tapers from an OD of between about 0.300 inch and about 0.465 inch to an OD of between about 0.335 inch and about 0.500 inch for woods, and from between about 0.330 inch and about 0.500 inch to between about 0.360 inch and about 0.530 inch for irons. The OD of cylindrical portion 76 is, therefore, between about 0.335 inch and about 0.500 inch for woods, and between about 0.360 inch and about 0.530 inch for irons. The OD of tapered portion 80 tapers from an OD of between about 0.300 inch and about 0.465 inch to an OD of between about 0.335 inch and about 0.500 inch for woods, and from between about 0.330 inch and about 0.500 inch to between about 0.360 inch to about 0.530 inch for irons.

Referring more specifically to the exemplary embodiments illustrated in FIGS. 2–6, the top hand portion 26 is preferably between about 4 inches and about 6 inches, while the bottom hand/bottom thumb portion 26 is preferably between about 4 inches and about 5 inches. The OD of the bottom hand/bottom thumb section 26 is preferably between about 0.58 inch and about 0.69 inch, The OD of the kick section 18 (FIG. 2), which is essentially a kick point, is preferably between about 0.55 inch and about 0.65 inch. The combined length of the connecting portions 28 and 30 is preferably between about 1 inch.

Turning to the exemplary embodiments illustrated in FIGS. 7–11, the top hand portion is preferably between about 3 inches and about 6 inches in length, the bottom hand portion is preferably about 3 inches in length, and the bottom thumb portion is preferably between about 2 inches and about 3 inches in length. The OD of the bottom thumb portion 52 is preferably between about 0.58 inch and about 0.69 inch. The length of the kick section 54, which consists of the cylindrical portion 58 in this embodiment, is preferably between about 0.5 inch and about 2 inches, while the OD of the kick section is preferably between about 0.55 inch and about 0.65 inch. The combined length of the connecting portions 56 and 60 is preferably between about 0.5 inch and about 1 inch.

Turning to the wall thickness of the commercial embodiments, the wall thickness of the tip section is preferably between about 0.061 inch to about 0.089 inch. The thickness of the main body section preferably decreases at a constant rate from the tip section to a thickness of between about 0.028 inch and about 0.039 inch at the proximal end of the main body section. The thickness of the kick section varies from between about 0.028 inch and about 0.044 inch. The thickness of the grip section is between about 0.028 inch and about 0.044 at the distal end and is between about 0.028 inch and 0.039 inch at the proximal (or butt) end of the shaft.

The present invention may be practiced with any of the materials typically used to produce composite resin/fiber golf club shafts. Suitable resins include, for example, thermosetting resins or polymers such as polyesters, epoxies, phenolics, melamines, silicones, polimides, polyurethanes, or other thermoplastics. Suitable fibers include, for example, carbon-based fibers such as graphite, glass fibers, aramid fibers, and extended chain polyethylene fibers. The preferred method of manufacturing is a bladder mold process. After successive layers (preferably 10–20) of fiber reinforced resin are wrapped around a bladder, a heated mold is placed over the wrapped bladder. The bladder is then expanded to force the material against the mold. The shaft is then cured in the mold. Curing times and temperatures depend on the polymer used in the composite and are well known to those of skill in the art. Alternatively, the present shaft may be manufactured by wrapping successive layers of fiber reinforced resin around a suitably shaped mandrel and then curing the shaft in an oven.

With respect to the layer wrapping employed in either process, the fibers of each successive layer are preferably oriented at different angles with respect to the longitudinal axis of the shaft. The fibers of some layers may be parallel to the longitudinal axis, while the fibers of other layers are angled from 30–90 degrees with respect to the longitudinal axis. It should be noted, however, that the fibers of successive layers, such as the outer layers, may be parallel to one another. Other layer combinations are also possible. For example, the first 5 to 10 layers may be alternating angled layers, and the next 5 to 10 layers may be parallel to the longitudinal axis.

Other manufacturing methods that may be used in conjunction with the present invention include filament winding and resin transfer molding.

It is suggested that the grips used in conjunction with the present shafts be thin (e.g. less than 3 mm thick) and flexible enough to conform to the shape of the shaft grip sections. Suitable grip materials include rubber and synthetic rubber. Such grips can be either tubular, or formed in a strip that is wrapped around the grip section in a manner similar to a tennis racket grip.

Although the present invention has been described in terms of the preferred embodiment above, numerous modifications and/or additions to the above-described preferred embodiments would be readily apparent to one skilled in the art. It is intended that the scope of the present invention extends to all such modifications and/or additions and that the scope of the present invention is limited solely by the claims set forth below.

I claim:

1. A golf club shaft, comprising:

a main body section defining a distal end and a proximal end; and a grip section associated with the proximal end of the main body section, the grip section including a top hand portion, a bottom hand portion and a substantially cylindrical bottom thumb portion, the top hand portion being one of substantially cylindrical and, tapered and the bottom hand portion being the other of substantially cylindrical and tapered, the top and bottom hand portions each being at least one inch in length, and the tapered portion having a substantially continuous taper.

2. A golf club shaft as claimed in claim 1, wherein the bottom hand portion of the grip section is substantially cylindrical and the top hand portion of the grip section is tapered.

3. A golf club shaft as claimed in claim 1, wherein the top hand portion of the grip section is substantially cylindrical and the bottom hand portion of the grip section is tapered.

4. A golf club shaft as claimed in claim 1, wherein the grip section defines a distal end outer diameter, the main body section defines a proximal end outer diameter, and the grip section distal end outer diameter is greater than the main body section proximal end outer diameter.

5. A golf club shaft as claimed in claim 1, wherein the grip section defines a distal end outer diameter, the main body section defines a proximal end outer diameter, and the grip section distal end outer diameter is substantially equal to the main body section proximal end outer diameter.

6. A golf club shaft as claimed in claim 1, wherein the grip section defines a distal end outer diameter, the main body section defines a proximal end outer diameter, and the grip section distal end outer diameter is less than the main body section proximal end outer diameter.

7. A golf club shaft as claimed in claim 1, wherein the grip section defines a distal end, the shaft further comprising:

a kick section between the distal end of the grip section and the proximal end of the main body section.

8. A golf club shaft as claimed in claim 1, further comprising:

a tip section associated with the distal end of the main body section.

9. A golf club shaft as claimed in claim 1, wherein the main body section defines an area of maximum outer diameter and the area of maximum outer diameter is substantially spaced from the grip section.

10. A golf club shaft as claimed in claim 1, wherein the main body section defines a substantially constant taper from the distal end to the proximal end.

11. A golf club shaft, comprising:

a main body section defining a distal end and a proximal end;

a grip section associated with the proximal end of the main body section, the grip section defining a distal end and including a top hand portion, a bottom hand portion and a substantially cylindrical bottom thumb portion, the top hand portion being one of substantially cylindrical and tapered and the bottom hand portion being the other of substantially cylindrical and tapered; and a kick section between the distal end of the grip section and the proximal end of the main body section;

wherein the grip section defines a distal end outer diameter, the main body section defines a largest main body section outer diameter, the kick section defines a smallest kick section outer diameter, and the smallest outer diameter of the kick section is less than grip section distal end outer diameter and the largest main body section outer diameter.

12. A golf club shaft, comprising:

a main body section defining a distal end and a proximal end;

a grip section associated with the proximal end of the main body section, the grip section defining a distal end and including a top hand portion, a bottom hand portion and a substantially cylindrical bottom thumb portion, the top hand portion being one of substantially cylindrical and tapered and the bottom hand portion being the other of substantially cylindrical and tapered; and a kick section between the distal end of the grip section and the proximal end of the main body section; and a first tapered portion which connects the distal end of the grip section to the kick section and a second tapered portion which connects the proximal end of the main body section to the kick section.

13. A golf club shaft as claimed in claim 12, wherein the kick section comprises an intersection between the first and second tapered portions.

14. A golf club shaft, comprising:

a main body section defining a distal end and a proximal end;

a grip section associated with the proximal end of the main body section, the grip section defining a distal end and including a top hand portion, a bottom hand portion and a substantially cylindrical bottom thumb portion, the top hand portion being one of substantially cylindrical and tapered and the bottom hand portion being the other of substantially cylindrical and tapered; and an elongate substantially cylindrical portion between the distal end of the grip section and the proximal end of the main body section.

15. A golf club shaft, comprising:

a main body section defining a distal end, a proximal end, and a largest main body section outer diameter;

a grip section defining a distal end, a proximal end, and a distal end outer diameter; and a kick section between the proximal end of the main body section and the distal end of the grip section, the kick section defining a smallest kick section outer diameter, and the smallest outer diameter, of the kick section being less than grip section distal end outer diameter and the largest main body section outer diameter.

16. A golf club shaft as claimed in claim 15, wherein the kick section wherein the kick section comprises an elongate substantially cylindrical portion.

17. A golf club shaft as claimed in claim 15, further comprising:

a first tapered portion which connects the distal end of the grip section to the kick section and a second tapered portion which connects the proximal end of the main body section to the kick section.

18. A golf club shaft as claimed in claim 17, wherein the kick section comprises an intersection between the first and second tapered portions.

19. A golf club shaft as claimed in claim 15, wherein the main body section defines a substantially constant taper from the distal end to the proximal end.

20. A golf club shaft as claimed in claim 15, wherein the main body section defines an area of maximum outer diameter and the area of maximum outer diameter is substantially spaced from the grip section.

21. A golf club shaft as claimed in claim 15, further comprising:

a tip section associated with the distal end of the main body section.

22. A golf club shaft, comprising:

a main body section defining a distal end and a proximal end; and a grip section associated with the proximal end of the main body section, the grip section including a top hand portion, a bottom hand portion and a substantially cylindrical bottom thumb portion, the top hand portion being one of substantially cylindrical and tapered, the bottom hand portion being the other of substantially cylindrical and tapered, the bottom thumb portion defining a distal end having a diameter, and the top hand portion defining a proximal end having a diameter that is at least 0.1 inch greater than the diameter of the distal end of the bottom thumb portion.

23. A golf club shaft as claimed in claim 22, wherein the top hand portion of the grip section is substantially cylindrical and the bottom hand portion of the grip section is tapered.

24. A golf club shaft as claimed in claim 22, wherein the main body section defines an area of maximum outer diameter and the area of maximum outer diameter is substantially spaced from the grip section.

25. A golf club shaft as claimed in claim 22, wherein the main body section defines a substantially constant taper from the distal end to the proximal end.

26. A golf club shaft, comprising:

a main body section defining a distal end and a proximal end;

a grip section defining a distal end and a proximal end; and an intermediate section between the proximal end of the main body section and the distal end of the grip section, the intermediate section including an inwardly tapered portion and an outwardly tapered portion and having one of a substantially constant and slightly tapered wall thickness.

27. A golf club as claimed in claim 26, wherein the grip section defines a distal end outer diameter, the main body section defines a largest main body section outer diameter, the intermediate section defines a smallest intermediate section outer diameter, and the smallest outer diameter of the intermediate section is less than grip section distal end outer diameter and the largest main body section outer diameter.

28. A golf club as claimed in claim 26, further comprising:

an elongate substantially cylindrical portion between the inwardly tapered portion and the outwardly tapered portion.

* * * * *